US006912881B2

(12) United States Patent
Kleinhaeni

(10) Patent No.: US 6,912,881 B2
(45) Date of Patent: Jul. 5, 2005

(54) SECURITY REVERSIBLE KEY AND LOCKING SYSTEM

(75) Inventor: Arno Kleinhaeni, Wernetshausen (CH)

(73) Assignee: Kaba Schliesssysteme AG, Wetzikon (CH)

( * ) Notice: Subject to any disclaimer, the term of this patent is extended or adjusted under 35 U.S.C. 154(b) by 0 days.

(21) Appl. No.: 10/018,060

(22) PCT Filed: Apr. 2, 2001

(86) PCT No.: PCT/CH01/00207

§ 371 (c)(1),
(2), (4) Date: Jul. 2, 2002

(87) PCT Pub. No.: WO01/77466

PCT Pub. Date: Oct. 18, 2001

(65) Prior Publication Data

US 2003/0101783 A1 Jun. 5, 2003

(30) Foreign Application Priority Data

Apr. 11, 2000 (CH) ..... 719/00
Apr. 11, 2000 (CH) ..... 720/00

(51) Int. Cl.[7] ..... E05B 27/00

(52) U.S. Cl. ..... 70/409; 70/406; 70/493; 70/421; 70/427

(58) Field of Search ..... 70/406, 409, 493, 70/390, 405, 407, 421, 423, 427

(56) References Cited

U.S. PATENT DOCUMENTS 3,974,670 A * 8/1976 Wolter ..... 70/493
4,098,104 A * 7/1978 Wolter ..... 70/406
4,122,694 A * 10/1978 Gretler ..... 70/406
4,139,877 A * 2/1979 Townsend ..... 360/267.8
4,325,241 A * 4/1982 Keller ..... 70/358
5,101,648 A * 4/1992 Kuster ..... 70/358
5,438,857 A 8/1995 Kleinhaeny
5,533,369 A * 7/1996 Valdajos-Gallego ..... 70/493
5,687,594 A * 11/1997 Wang ..... 70/495
5,822,921 A * 10/1998 Griepenstroh et al. ..... 49/350
5,964,112 A * 10/1999 Stefanescu ..... 70/493
6,378,739 B1 * 4/2002 Maas et al. ..... 222/383.1
6,438,857 B2 * 8/2002 Jacobs et al. ..... 33/503
6,490,898 B1 * 12/2002 Mottura ..... 70/495

FOREIGN PATENT DOCUMENTS

CH 651 350 A5 9/1985
DE 32 25 952 A1 1/1984
DE 3542008 A1 * 6/1987
EP 0 605 932 A2 7/1994

* cited by examiner

*Primary Examiner*—Chuck Y. Mah
*Assistant Examiner*—Michael J Kyle
(74) *Attorney, Agent, or Firm*—Rankin, Hill, Porter & Clark LLP

(57) ABSTRACT

The security reversible key with an assigned cylinder (Z) has a blocking groove (BN) with a coded blocking depth (B1, B2, B3), which runs parallel to the axis of the key (x) from the tip of the key to at least the first position (P1) of a row of tumbler pins (A2) on the key. In the assigned cylinder, at least at the rearmost coding position (P1), a pair of tumbler pins corresponding to the blocking groove (BN) with a blocking tumbler pin (BZ) and an extended blocking counter pin (BG) are foreseen, whereby the blocking counter pin (BG) impinges on the cylinder housing (10), if the blocking groove is insufficiently deep and, with this, the complete insertion of a key with an insufficiently deep blocking groove is blocked by the pair of blocking tumbler pins. Simultaneously, the blocking tumbler pin (BZ) with the counter pin (BG) at the position (P1) also serves as coding tumbler pin. In the case of the locking system with security reversible keys for locking installations at least two areas are defined, In a first area (G1) several additional security elements and a blocking code function are provided while, in the second area (G2), a more simple basic coding are foreseen. With the first area (G1), an unequivocal segmentation into independent market areas (M1, M2, M3) is defined and, with this, a world-wide unique locking system with enhanced security and applicability is created.

22 Claims, 14 Drawing Sheets

| HS | H | G | Vi | aut |
|---|---|---|---|---|
| | H1 | G1 | Cod 2, Cod 3 BC, KF/KS, 23 | |
| | H1/2 | G1/2 | 23, Cod 2 | |
| | H2 | G2 | Cod 1 | |

SECURITY REVERSIBLE KEY AND LOCKING SYSTEM

BACKGROUND OF THE INVENTION

The invention concerns a security reversible key with an assigned cylinder, a locking system with security reversible keys for locking systems, and a method for their manufacture. Such keys and locking systems are known, where the keys with a high degree of security and a correspondingly high number of possible coding permutations. The keys have at least three, and preferably at least four coding tumbler pin rows. The tumbler row pins are located on the flat sides of the key in order to make the best possible use of the available key surface, as well as the corresponding space requirement for the tumbler pin rows in the cylinder. Keys with additional security elements are also known, which once again require a certain amount of space.

From U.S. Pat. No. 5,438,857, such a key is known, with an insertion blocking system as an additional security element. In the '857 key an additional control face is located on the key that, by means of an assigned control pin at the cylinder entrance, prevents the insertion of a wrong key. This control pin is longer than a coding pin and extends beyond the central bisecting plane of the key. The control face is arranged at the tip of the key and rising, and it correspondingly also extends beyond the central bisecting plane of the key and lifts the control pin and pushes the control pin out of the way. As a result of this, the control pin prevents the insertion of keys without a correct control face. The control faces can already be affixed to the key blank and with this enable a protection of the blank.

These known high-security keys and systems with high-security keys are also always limited by the space available for the coding and security functions on the key and in the cylinder. Their manufacture calls for a central production, which limits, renders more difficult, and delays the world-wide universal application of such systems. Also, an optimum design for installations and applications of any kind is severely restricted by this.

SUMMARY OF THE INVENTION

It is an objective of the present invention to create a security reversible key with an assigned cylinder. More specifically, it is an objective of the invention to provide a locking system with security reversible keys and assigned cylinders, which can be utilized as a world-wide unique locking system, with higher permutation capacities for any kind of application, with enhanced security and copy protection as well as with new possibilities of being in a position to separate any kind of market area and application world-wide, and whereby, without any additional space requirement on keys and cylinders, a higher security and a greater number of permutations is achieved. A further objective of the present invention is a manufacturing method for a system of this kind, which can rapidly and universally be brought into use and applied world-wide.

In accordance with the present invention, a security reversible key has an assigned cylinder, a locking system has security reversible keys with assigned cylinders, and a method is provided to manufacture such keys. With the new additional security element "blocking code", which comprises a coded blocking groove and an assigned pair of blocking tumbler pins, without any additional space requirement on the key and in the cylinder, i.e., with the existing coding positions on the key and the existing pin rows and positions in the cylinder, an additional insertion blocking system as well as a higher number of permutations and applications are achieved. With the division into areas on the key, whereby the first area with additional security elements defines an unequivocal segmentation into independent market areas, a system is created that corresponds to the above named objective and which can be realized with the new, multi-step manufacturing process.

Especially with the new additional security element "blocking code", which comprises a coded blocking groove and an assigned pair of blocking tumbler pins, without any additional space requirement on the key and in the cylinder, i.e., with the existing coding positions on the key and the existing pin rows and positions in the cylinder, an additional insertion blocking system as well as a higher number of permutations and applications are achieved.

BRIEF DESCRIPTION OF THE DRAWINGS

These and further features of the invention are apparent with reference to the following description and drawings, wherein.

DETAILED DESCRIPTION OF THE PREFERRED EMBODIMENTS

Figure 1A:
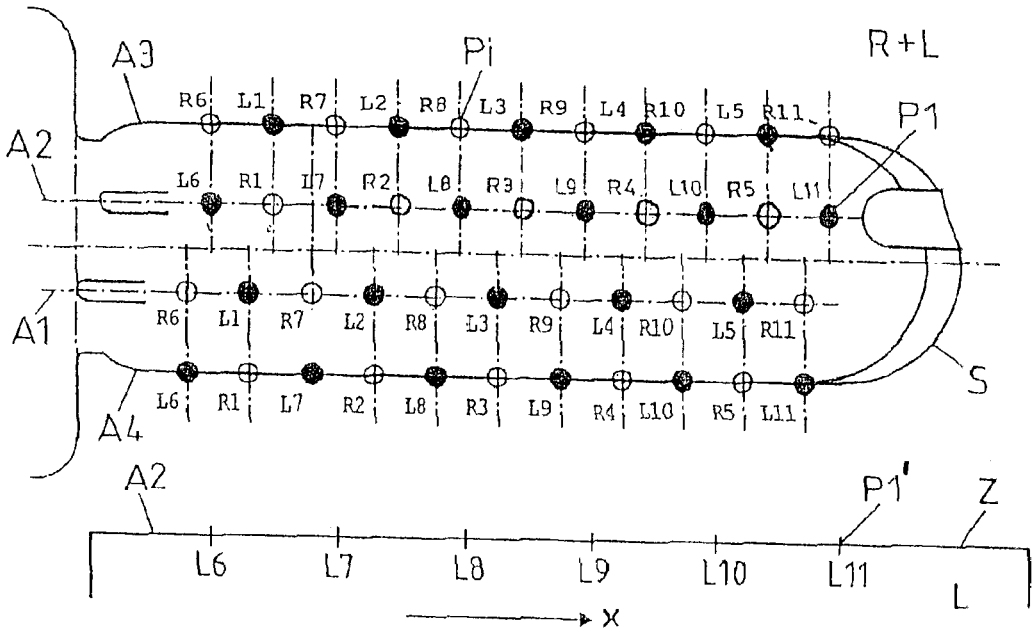
FIG. 1*a* shows coding rows with coding positions for two bore patterns on one key.

FIG. 1*a*, as an example, illustrates a safety turning-key S with four pin rows A1 to A4 and with 22 coding positions Pi, each one for a bore pattern left (L) and a bore pattern right (R). The coding row A2 on the key S here has the positions R1 to R5 for the bore pattern R and the positions L6 to L11 for the bore pattern L. On the keys, all positions of both bore patterns can be coded. For example, there are keys with bore pattern left, keys with bore pattern right and also keys with the two bore patterns R+L. In the assigned cylinder Z, however, for reasons of space for the pins, only every second position and, with this, only either a bore pattern R or a bore pattern L can be equipped with tumbler pins (in the same area). The first coding position P1 (=L11) on the tip of the key here corresponds to the rearmost tumbler pin position P1' in the cylinder with respect to the direction of insertion x of the key S.

Figure 1B:
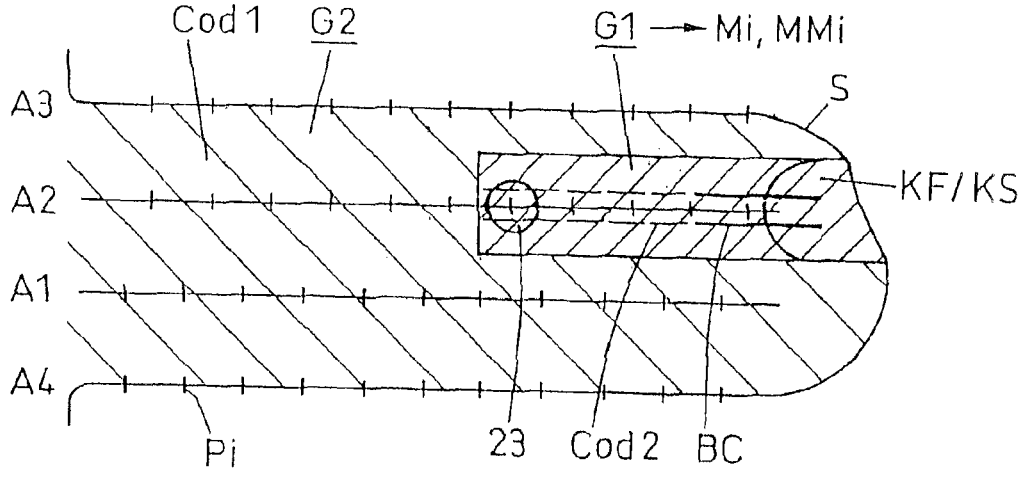
FIG. 1*b* shows on a key a division into areas, with a first area with additional security elements.

FIG. 1*b* illustrates the locking system in accordance with the invention on a key S, whereby on the key at least two areas are defined with a first area G1, in which at least two additional security elements with a higher degree of difficulty to manufacture are foreseen, and with a second area G2, in which a simple basic coding Cod1 is foreseen. With the first area G1 an unequivocal segmentation into independent market areas Mi=M1, M2, etc. is defined.

Also illustrated here are additional security elements, which in the following are more accurately defined: a blocking code BC, a second coding Cod2, preferably with a narrow milling, an insertion blocking system by means of a control face and control pin KF/KS and a flank control of Cod2 by means of a flat pin 23. The simple basic coding Cod1 is, for example, a coding by means of bores, which is relatively easily implementable anywhere decentralized.

Figure 1C:
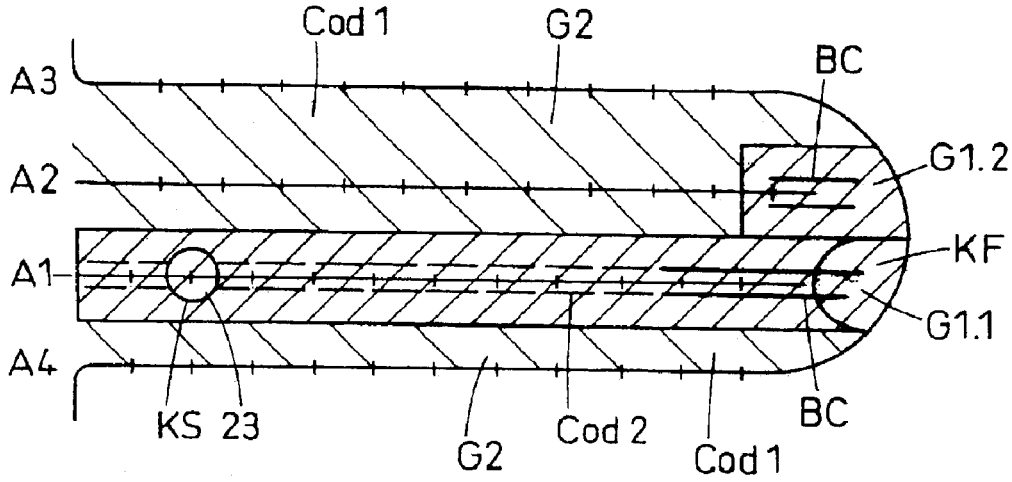
FIG. 1*c* shows a further example of a division into areas.

FIG. 1*c* depicts a different division into areas, whereby the area G1 can be divided into several part areas G1.1, G1.2, etc. Depending on the application and on the desired system design, the area G1 can, for example, encompass a whole coding row A1. In doing so, also all security elements are affixed in this one coding row. In a different advantageous variant, for example, also parts of areas with positions at the very front of the key of two coding rows (A1, A2) can form the area G1, whereby both parts of areas G1.1, G1.2 can each respectively have a blocking code BC.

Figure 1D:
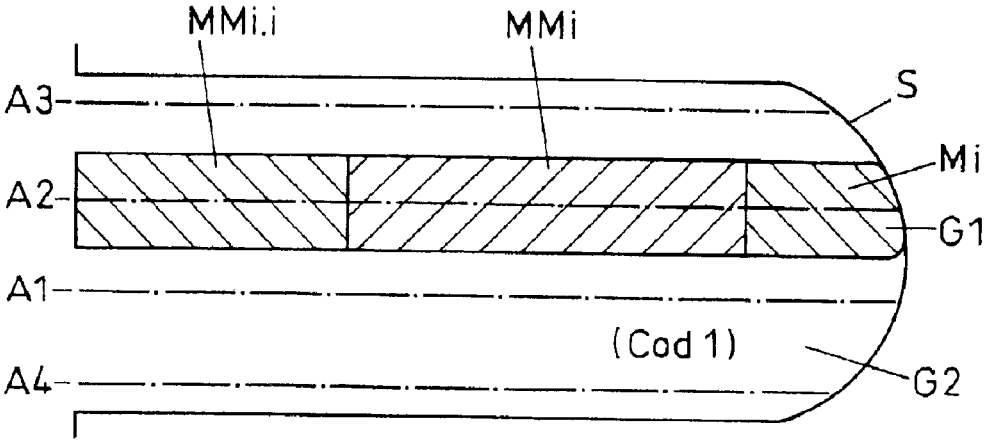
FIG. 1*d* shows a segmentation of market areas and distributor areas on a key.

FIG. 1*d* illustrates the division into several independent market areas Mi=M1, M2, etc., as well as the possible further sub-division of each market area into parts of market areas MMi on the key, which for example, correspond to independent distributor areas or fields of application for installations and objects, etc. The market areas Mi are defined with the area G1. The parts of areas MMi can be defined with parts of the area G1 or also with parts of the area G2 or they can equally encompass parts of the areas G1 and G2.

Figure 1E:
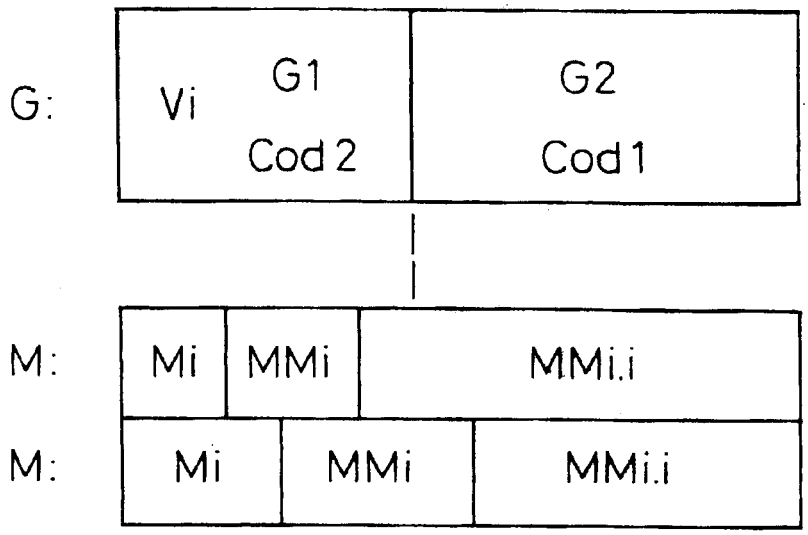
FIG. 1*e* shows a connection between division into areas and segmentation of market areas.

FIG. 1*e* illustrates, for example, a connection between the areas G1, G2 on the key and the unequivocal separation in the market area Mi, parts of market areas MMi as well as the further subdivisions for objects MMi.i. This is further explained hereinafter with reference to FIG. 18.

Advantageously, the area G1 contains at least three security elements Vi. Particularly important and advantageous is the new additional security element "Blocking Code". In the case of the blocking code BC, as an additional coding and security function in accordance with the invention explained in FIG. 2, the coding position P1 and its function on the key S and in the cylinder Z are maintained.

Figure 2:
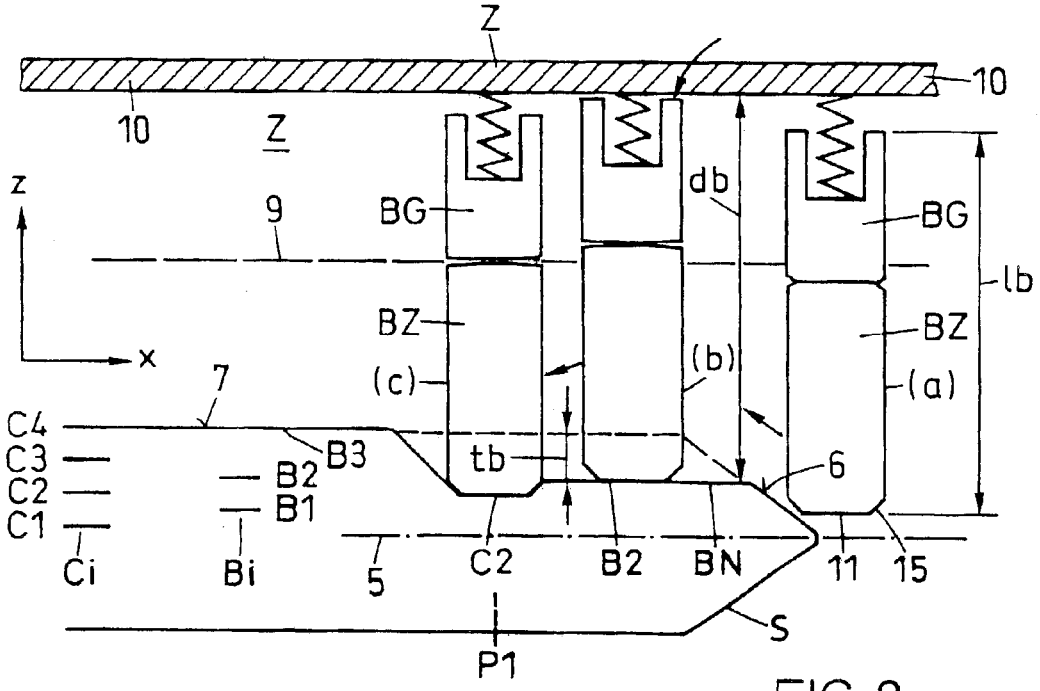
FIG. 2 shows the principle of the blocking code with blocking groove and blocking tumbler pin pair.

FIG. 2 schematically illustrates the method of operation of the blocking code BC in accordance with the invention on a key S and in an assigned cylinder Z. The directions in space are in the following designated with x, y, z, with x being the axis of the key and cylinder. The key has a blocking groove BN milled therein. The blocking groove BN runs parallel to the key axis x and extends at least up to the first coding position P1. In the assigned cylinder, correspondingly at least at the rearmost coding position P1', a pair of blocking tumbler pins is disposed. The blocking pins include a spring loaded blocking tumbler pin BZ and an extended blocking counter pin BG. The blocking groove has a coded blocking depth B1, B2, B3 and, in correspondence with this, the length lb of the pair of blocking tumbler pins (BZ+BG) is coded such that the length lb corresponds to the distance db of the blocking groove BN from the cylinder housing 10. In other words, the pair of blocking tumbler pins (or pair of blocking pins) fits in the blocking groove BN with little play. When inserting the key, the following sequence results (a-b-c): The blocking tumbler pin BZ is lifted at a beveled lead-in face 6 of the key up to the level of the blocking groove BN and with little play with the cylinder housing 10 passes through the blocking groove up to the corresponding coding position P1, whereby the blocking tumbler pin BZ is lowered into this first coding position with a certain coding step, here, e.g., C2. In this position P1 the pair of blocking tumbler pins BZ, BG operates as normal coding position with respect to turning of the cylinder, which in case of a correct coding has to release the shear line 9. If the blocking groove BN is not deep enough, such as when it has a wrong coding Bi, then the blocking counter pin BG impinges on the cylinder housing 10 and the further insertion of the key is blocked at the beveled lead-in face (if lb is larger than db, refer to FIG. 8*a*). The blocking code therefore results in an additional security function, in that the complete insertion can be prevented with additional coding steps (Bi) of the blocking groove, whereby the coding function up until now at the position P1 is maintained. Over and above this, neither the key, (i.e., on the key positions) nor the cylinder requires additional space for the blocking code. In the cylinder simply an up until now the normal coding tumbler pin is replaced by the special blocking tumbler pin.

Figure 3:
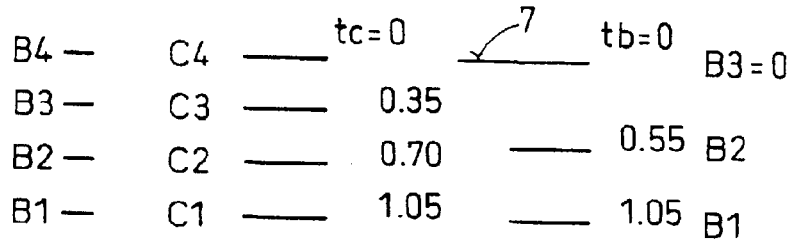
FIG. 3 shows examples of coding steps and blocking steps.
Figure 3:
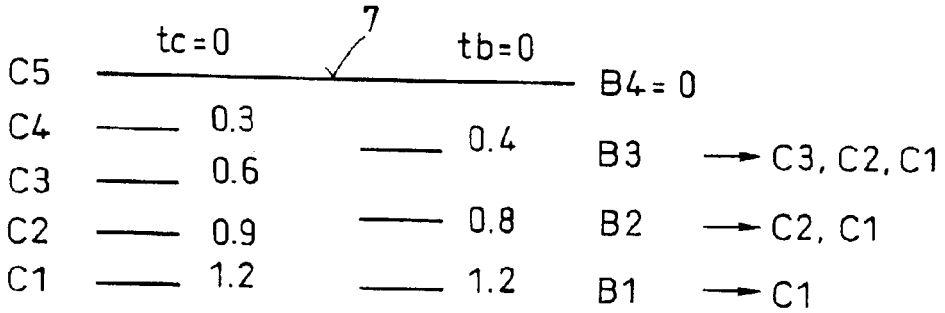

FIG. 3 illustrates possible blocking steps Bi with a depth tb in comparison with the coding steps Ci with the coding depths tc relative to the key surface. In the following examples, here coding steps C1 to C4 (e.g., steps of 0.35 mm) as well as three blocking steps B1, B2, B3 with blocking depths of, e.g., 1.05, 0.55 and 0 mm are utilized, whereby a blocking step B3 with a depth of 0 mm cannot exert a blocking function anymore. The blocking depths Bi can also correspond to the coding depths Ci, therefore, e.g., C1 to C4 and B1 to B4. In a further example, five coding steps C1 to C5 are represented in combination with four blocking steps B1 to B4, e.g., with step distances of 0.3 mm of the Ci and of 0.4 mm of the Bi. In accordance with the combination rule for the blocking steps Bi with the coding steps Ci, the coding depth tc of the coding steps Ci must not be smaller than the blocking depth tb of the preceding blocking groove Bi. In this example, therefore the blocking step B3 can be combined with the subsequent coding steps C3, C2 or C1.

Figure 4A:
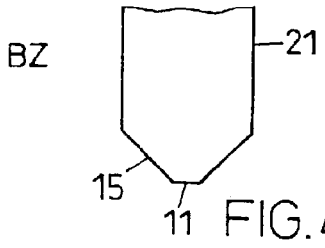
FIG. 4 shows examples of different tumbler pin shapes.
Figure 4B:
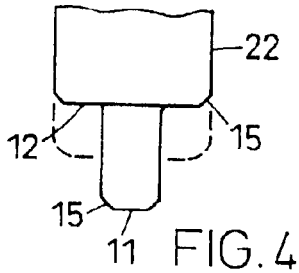
Figure 4C:
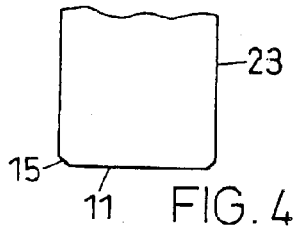
Figure 5A:
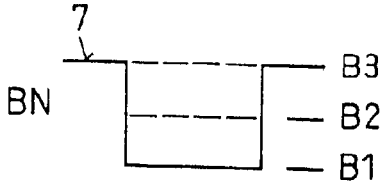
FIG. 5 shows blocking groove shapes corresponding to FIG. 4.
Figure 5B:
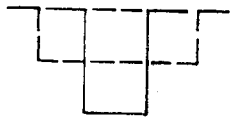
Figure 5C:
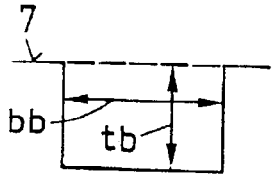
Figure 6A:
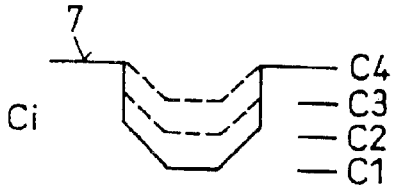
FIG. 6 shows coding shapes corresponding to FIG. 4.
Figure 6B:
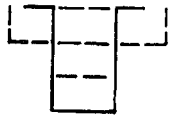
Figure 6C:
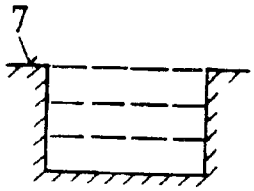

FIGS. 4, 5 and 6 illustrate various possible tumbler pin shapes (FIGS. 4*a, b, c*), assigned forms of the blocking grooves BN (FIGS. 5*a, b, c*) as well as the coding shapes assigned to the tumbler pins (FIGS. 6*a, b, c*). FIG. 4*a* illustrates a conventional conical tumbler pin shape 21, such as for a basic coding Cod1, which can be manufactured by means of simple bores (FIG. 6*a*). FIG. 4*b* depicts a narrow, cylindrical tumbler pin shape 22 with correspondingly narrow coding grooves (FIG. 6*b*), the manufacturing of which calls for a difficult to copy, elaborate milling process and which, for example, can be utilized as a second coding Cod2. FIG. 4*c* illustrates a flat pin 23, which, e.g., can be utilized for the flank control of a narrow milled coding (FIG. 6*b*), as will be explained in more detail later on. Further tumbler pin shapes are possible and known, which in principle are a combination of cylindrical and conical sections. The blocking groove shapes and the coding shapes can be implemented differently and as a result make any copying more difficult and also have the effect of additionally obscuring the coding shapes.

Figure 7A:
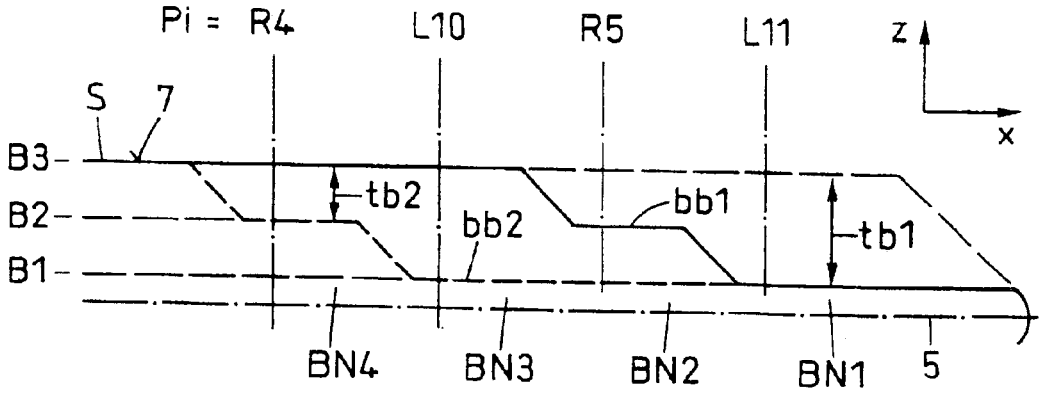
FIG. 7 shows a blocking groove extending over four positions with differing sectors.
Figure 7B:
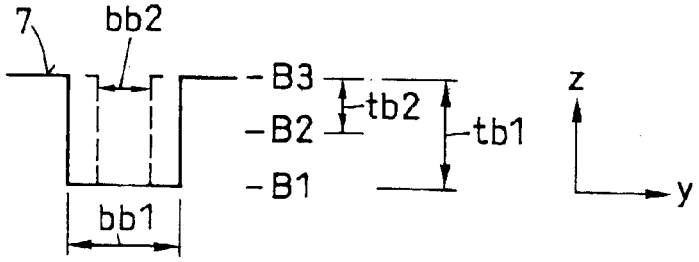
Figure 7C:
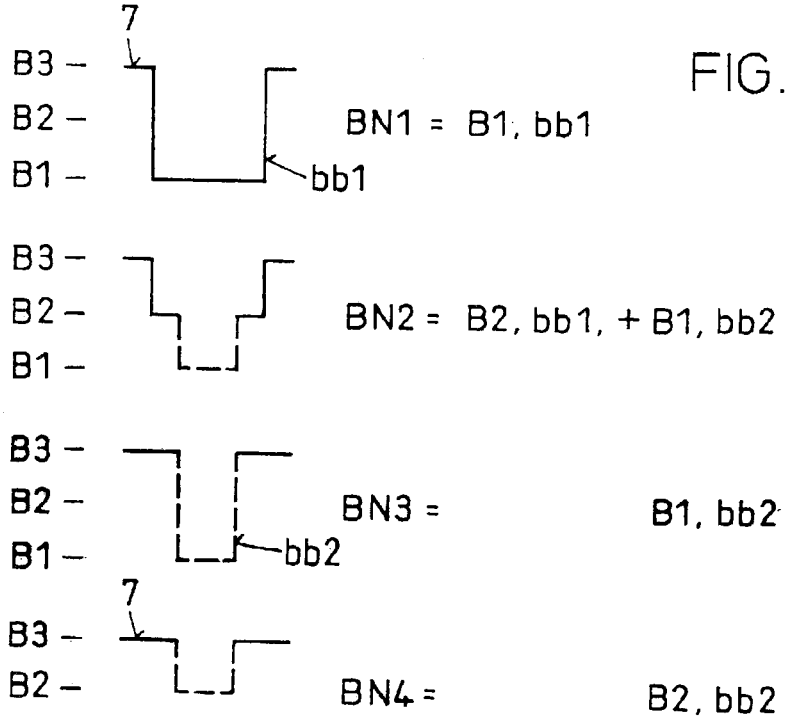

The FIGS. 7*a, b, c* illustrate an example of a blocking groove, which extends over the four most forward coding positions Pi=L11, R5, L10 and R4 of two bore patterns R, L and which correspondingly have several differently coded sectors BN1 to BN4. In doing so, as a rule attention must be paid, that the depth tb of the blocking grooves remains the same from one position to the next position or else becomes smaller (i.e., cannot become bigger) and that equally the width bb of the blocking grooves remains the same from one position to the next one or else becomes smaller. This in conjunction with three blocking steps B1 to B3 and with two blocking groove widths bb1 and bb2 results in the illustrated blocking steps Bi, bbi of the four blocking groove sectors BN1 to BN4.

Figure 8A:
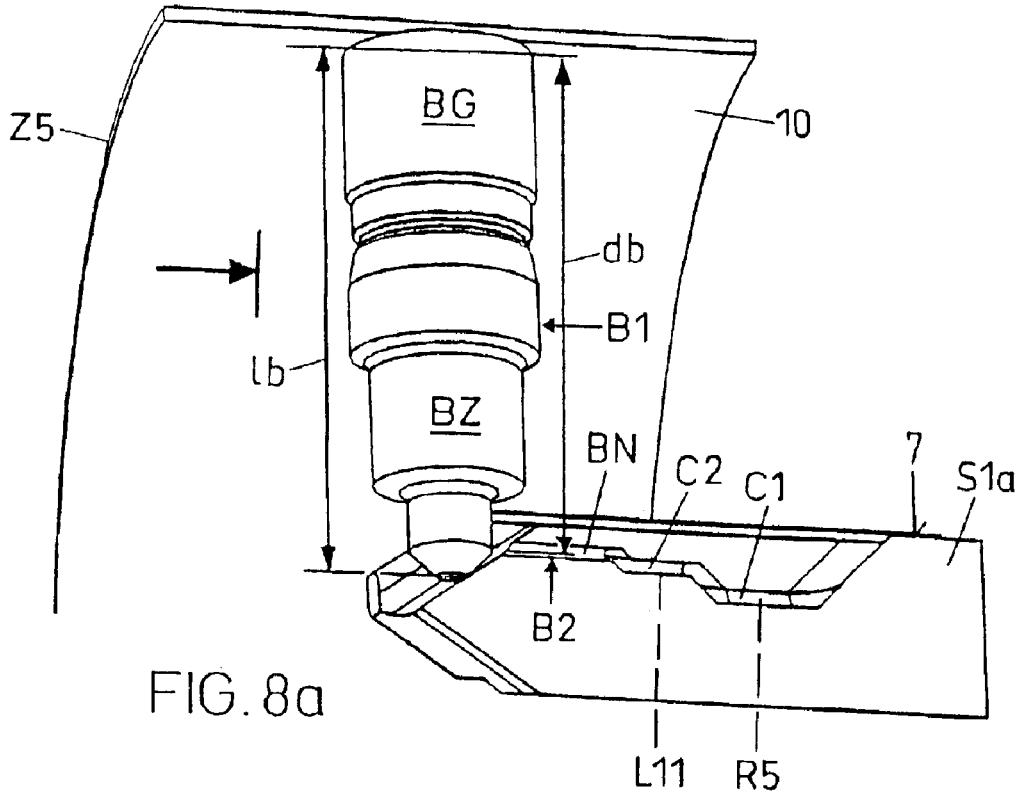
FIG. 8 shows, in a three-dimensional representation, a blocking groove with a blocking tumbler pin pair.
Figure 14:
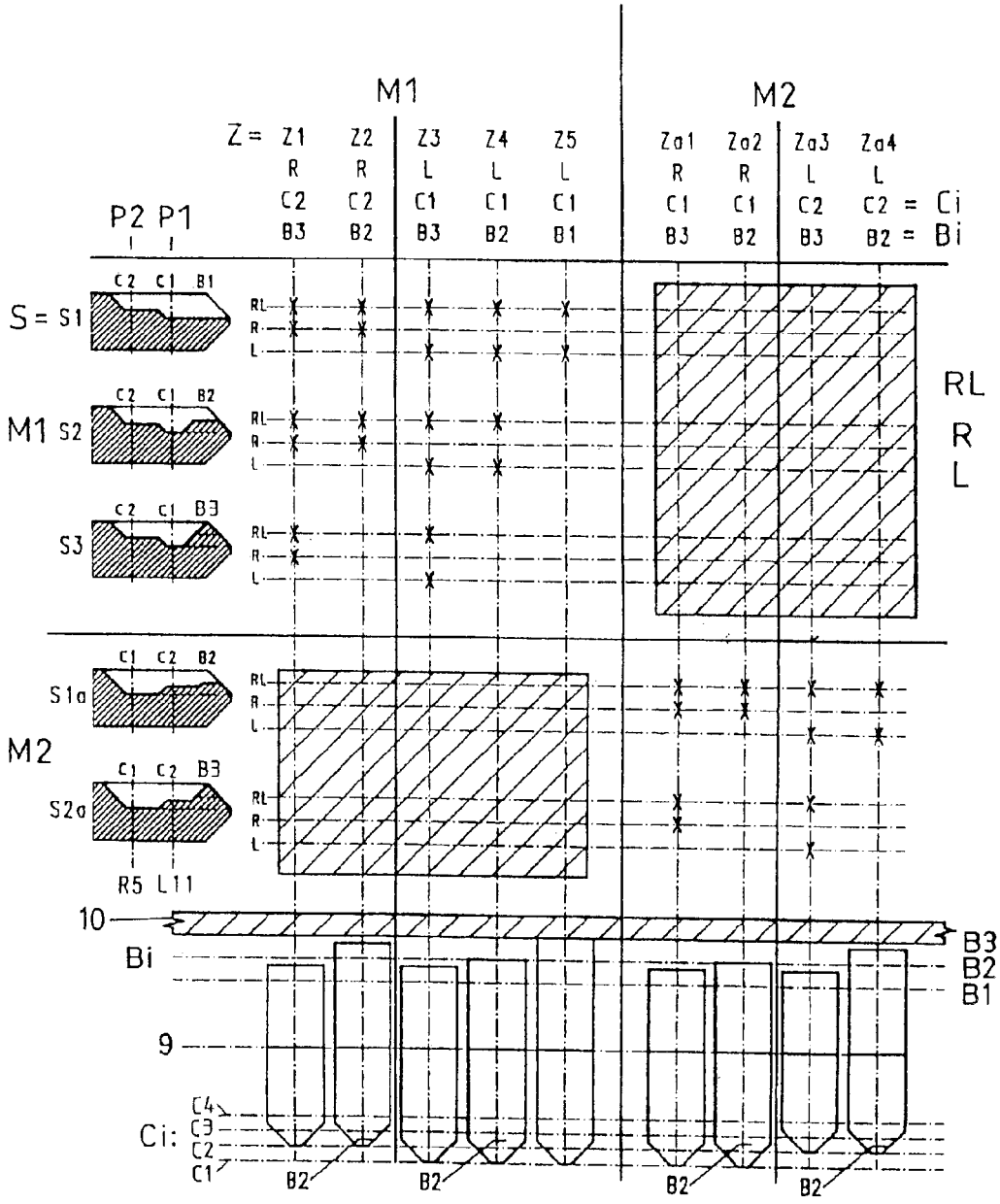
FIG. 14 shows a schematic locking function diagram with two bore patterns and tow market areas.

FIG. 8 illustrates the function of the blocking code in a three-dimensional depiction and FIG. 9 blocking groove shapes and the adjacent coding indentations, which correspond to the example of FIG. 14. In FIGS. 8*a, b* a key S1*a* is illustrated, with a blocking groove, which has a blocking step B2 and with adjacent coding positions L11 and R5, which have the codings C1 and C2 (corresponding to the key S1*a* of FIG. 14).

Figure 8B:
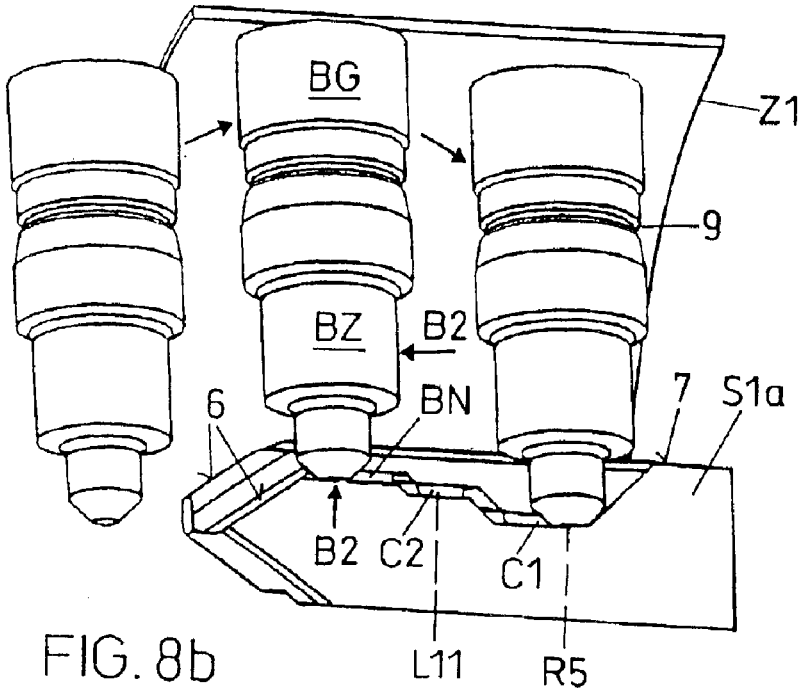
Figure 9A:
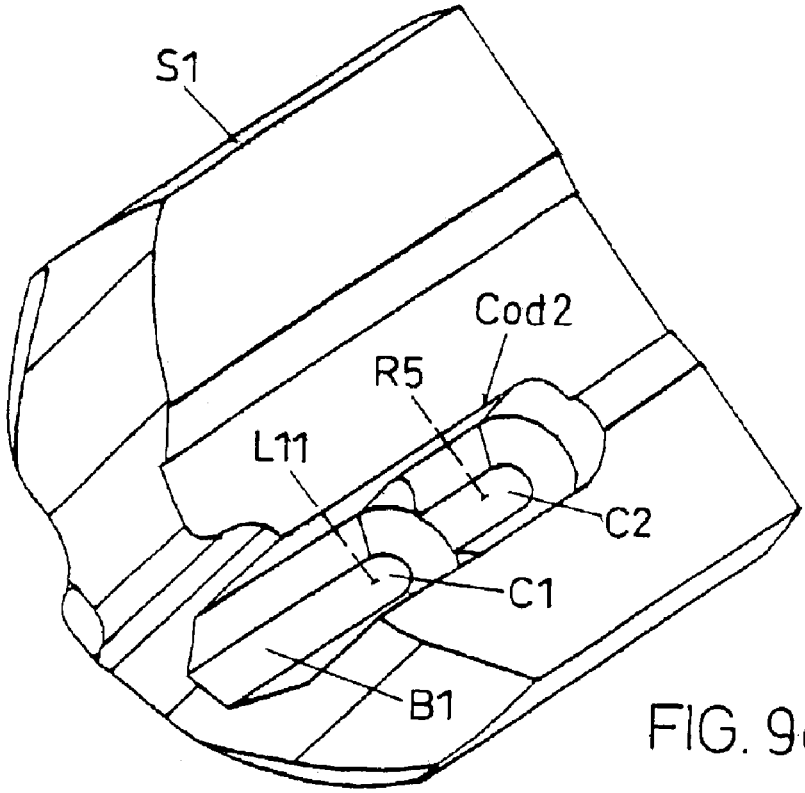
FIG. 9 shows, in a three-dimensional representation, different examples of blocking grooves with coding positions (corresponding to the example of FIG. 14)
Figure 9B:
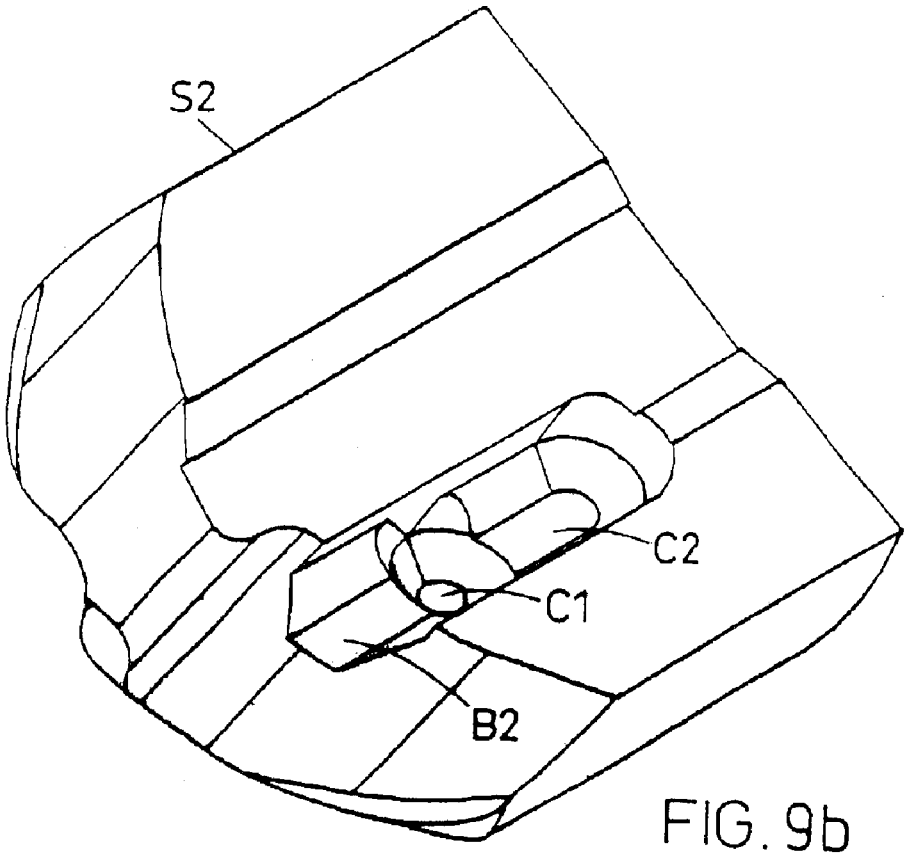
Figure 9C:
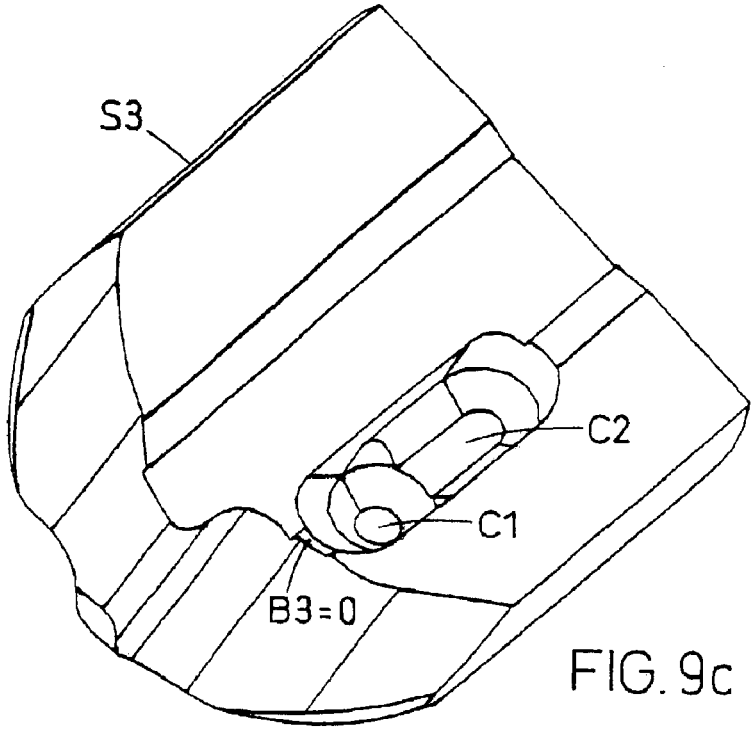
Figure 9D:
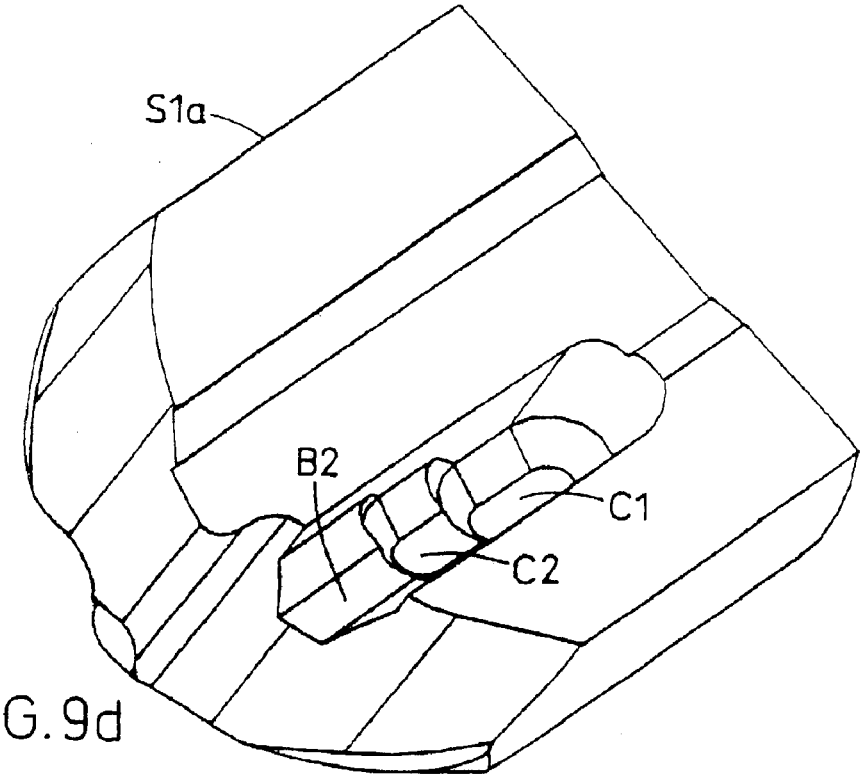

FIG. 8*a* illustrates a pair of blocking tumbler pins BZ, BG with blocking code B1, the length lb of which is greater than the distance db of the blocking groove from the cylinder housing 10. With this, the complete insertion of the key S1*a* into this cylinder is blocked. FIG. 8*b* in contrast illustrates a pair of blocking tumbler pins BZ, BG with a blocking code B2, which corresponds to the blocking code B2 of the blocking groove BN and which, therefore, can be completely inserted. This in the schematic diagram of FIG. 14 corresponds to the key S1*a*, which opens the cylinder Z1 (with coding C1 at the position R5).

The FIGS. 9*a* to 9*d* illustrate the keys S1, S2, S3 and S1*a*, with differently coded blocking grooves and positions L11 and R5. This also corresponds to the schematic locking function diagram of FIG. 14, which indicates, which key-cylinder combinations open and which ones block.

Figure 10:
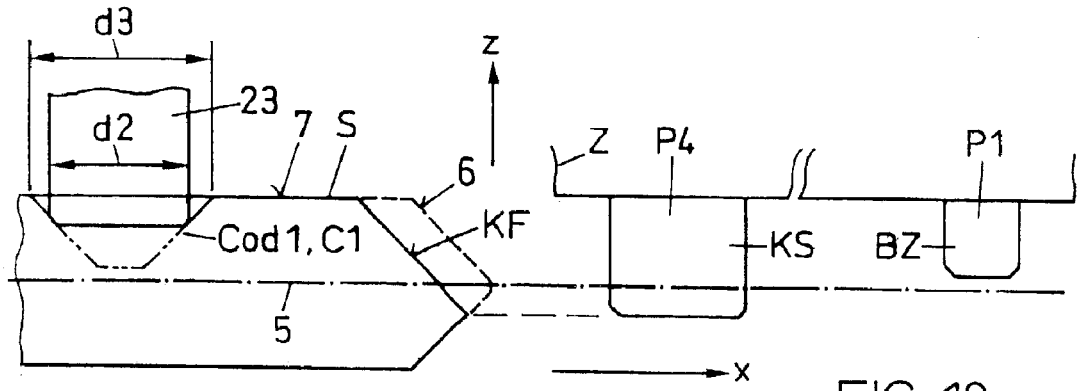
FIG. 10 shows a security element "insertion block" by means of a control face and a control pin.

FIG. 10 as possible additional security element illustrates an as such known insertion blocking system by means of a control face KF at the tip of the key and an assigned control pin KS in the cylinder. This control face KF extends beyond the central bisecting plane 5 of the key, the same as the control pin KS, which impinges on the rising control face KF and has to be pushed out of the way by it in order for the key to be able to be inserted. A key without the right control face, resp., with only normal lead-in faces 6, with its tip encounters this control pin KS, so that the latter prevents the insertion of the key. This is a completely different arrangement and action than according to the blocking code in accordance with the invention, which does not require any special control faces, but works rather more with any existing key lead-in face 6. Advantageously, however, the new blocking code with the blocking tumbler pins BZ can be combined with this known insertion block by means of control faces KF and control pin KS and in particular even be assigned in the same tumbler pin row (e.g., A2), whereby the control pin KS is positioned anywhere in front of the pair of blocking tumbler pins BZ, BG in the cylinder.

Figure 11A:
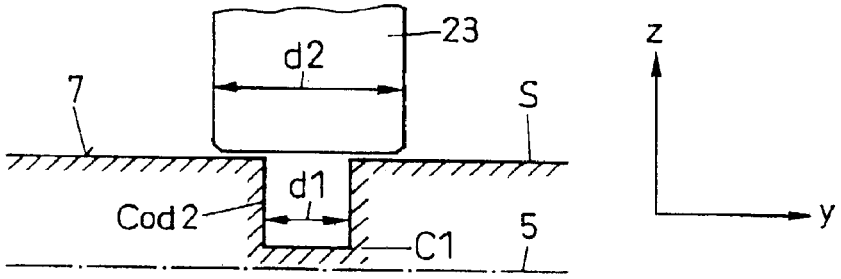
FIG. 11 shows a security element "flat pin" for the flank control of codings.
Figure 11B:
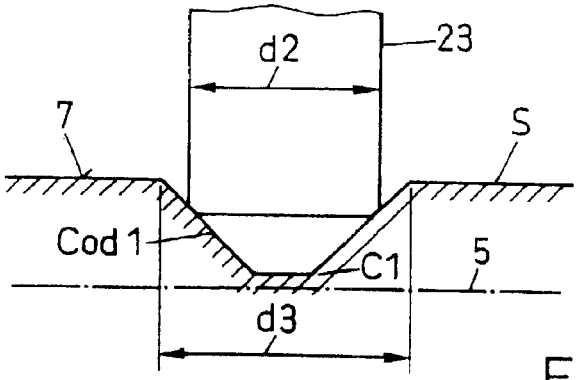

A further important additional security element, which can also be assigned in the same tumbler pin row, is illustrated in FIGS. 11*a*, 11*b*. These illustrate a flank control at a narrow coding milling Cod2, which is implemented by a flat tumbler pin 23. The flat tumbler pin 23 (refer to, e.g., FIG. 4*c*) has a diameter d2, which is greater than the width d1 of the coding milling, so that the flat tumbler pin lies on the key surface 7, as is depicted in FIG. 11*a*. In contrast, in the case of a basic coding Cod1, e.g., in accordance with FIG. 6*a*, with necessarily wide bores d3 the flat tumbler pin 23 will sink into these indentations in accordance with FIG. 11*b*, whereby the shear line 9 of the cylinder is blocked. With this, e.g., a simple forged bore instead of the authorized, much more elaborate narrow coding milling Cod2 can be detected and the functioning of a key forged in this manner be prevented.

Advantageously therefore in a tight space and in a single tumbler pin row the following very effective security elements can be combined: in addition to the blocking code BC in accordance with the invention, a second coding Cod2 with a narrow milling, an insertion control by means of control pin KS and control face KF as well as a flank control of the narrow coding Cod2 by means of a flat tumbler pin 23.

Figure 12:
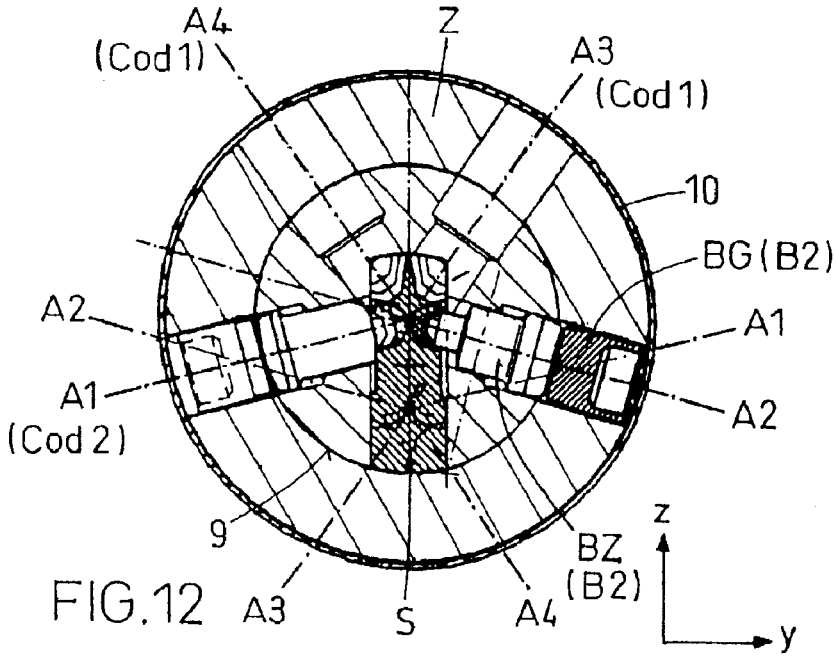
FIG. 12 shows a key with four rows of tumbler pins and with blocking pins in the cylinder.

FIG. 12 illustrates a cross section through a safety turning-key with four rows of tumbler pins A1 to A4 in a cylinder in accordance with the example of FIG. 1. The row A1 here is implemented with a narrow coding milling Cod2 and with a pair of blocking tumbler pins BZ, BG. The rows A3 and A4 (and optionally also the row A2) here are implemented with a simpler basic coding Cod1. Important is to exploit the given key surface and the space inside the cylinder in the best possible way for coding positions and security elements. To achieve this, of necessity (at least two) rows of tumbler pins also have to be located on the flat sides of the key.

In the case of somewhat bigger keys, it is also possible to foresee more than four rows of tumbler pins.

Figure 13A:
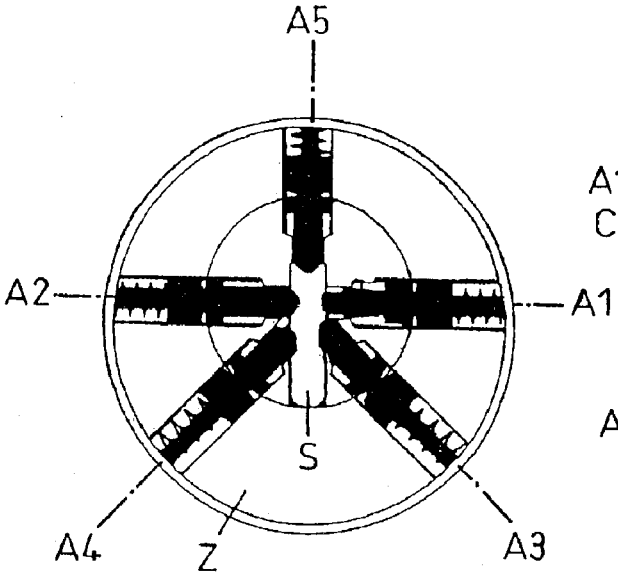
FIG. 13 shows examples of keys with five and with eight coding or tumbler pin rows.
Figure 13B:
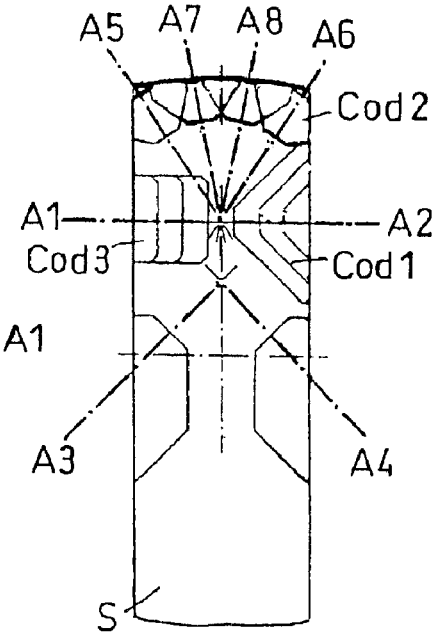

FIG. 13*a* for this purpose illustrates an example with five rows of tumbler pins A1 to A5 and FIG. 13*b* an example with eight rows of tumbler pins A1 to A8, which, however, can only be equipped with tumbler pins in the cylinder to such an extent as space is available. Thanks to the utilization of narrow codings, however, it is also possible to code all eight rows on the key here. This results in a great number of possible permutations as well as in further security reserves. In principle, here too at the beginning of every row of tumbler pins Ai, a blocking coding can be provided.

In the FIGS. 14 to 17, schematic locking function diagrams with different combinations of blocking codes Bi and codings Ci of the adjacent positions Pi are illustrated. In the left-hand column, the codings Bi, Ci of the keys Si are indicated and in the row on top the codings of the cylinders Zi. The keys can have the bore patterns R or L, or R+L (both), while the cylinders can only contain one bore pattern R or L. The schematic diagram indicates with an "X", whether a combination key/cylinder fits, i.e., whether the key opens the corresponding cylinder. All other combinations block. The FIGS. 14 to 17 illustrate how, with few blocking codings Bi and adjacent position codings Ci, different market areas Mi can be unequivocally differentiated between, and how within a market area several derivations, i.e., hierarchic differentiations, of keys can be implemented within an installation.

The schematic diagram of FIG. 14 (which corresponds to the FIGS. 8 and 9) illustrates codings Ci with two bore patterns and with two positions P1=L11 and P2=R5 with 5 equipping alternatives with blocking steps Bi=B1, B2, B3 of the blocking grooves and coding steps Ci=C1 and C2.

Defined with this are two independent market areas M1, M2 With three, resp., two derivations. The key S3, e.g., opens the cylinders Z1 and Z3.

Figure 15:
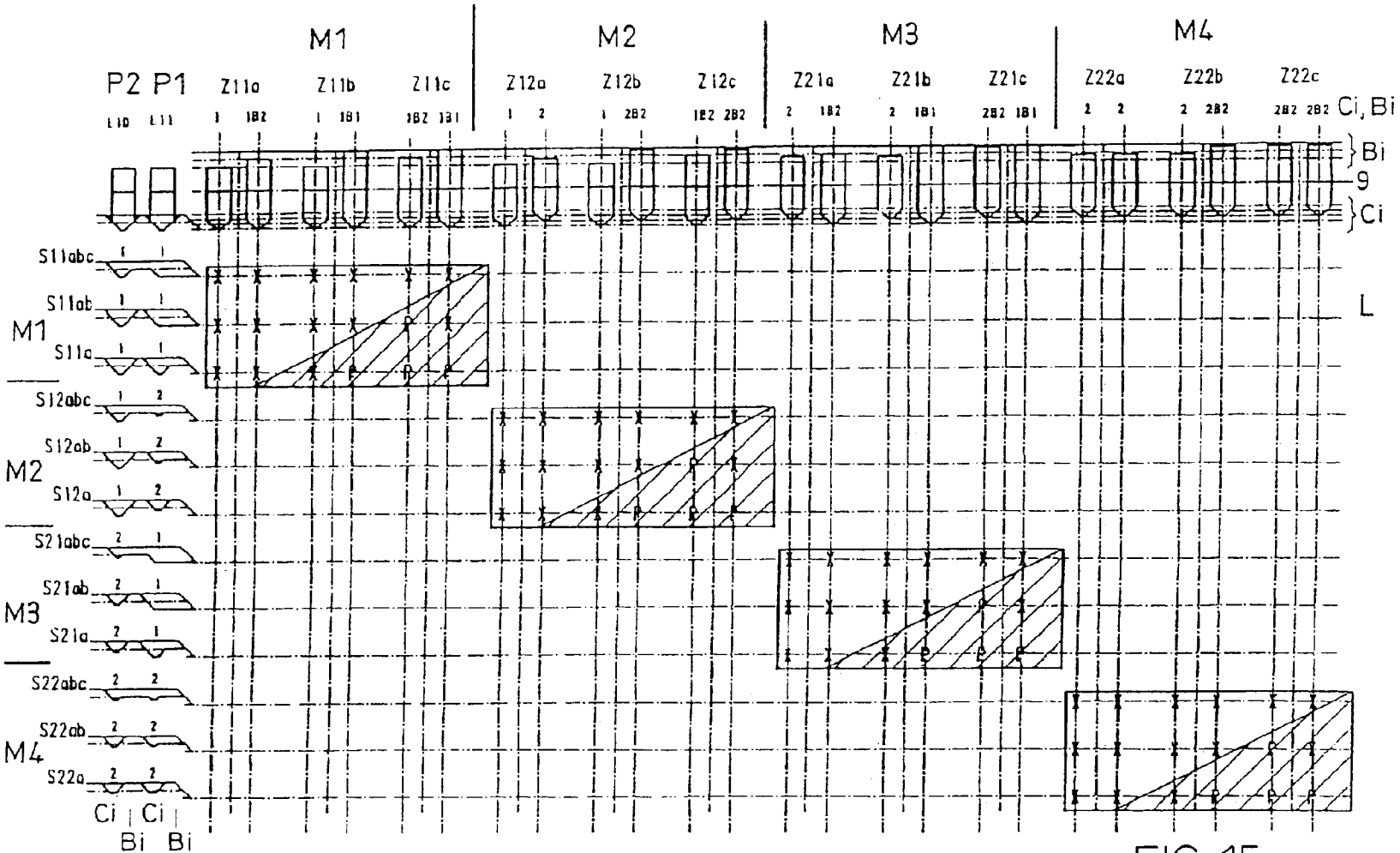
FIG. 15 shows a schematic locking function diagram with two positions and four market areas.

FIG. 15 illustrates only one bore pattern L with blocking code over two positions P1=L11 and P2=L10 with blocking steps B1, B2, B3 and with coding steps C1, C2.

Defined with this are four independent market areas M1 to M4, each with three derivations.

For example, the key S11*abc* opens the cylinders Z11*a*, Z11*b*, Z11*c*.

Figure 16:
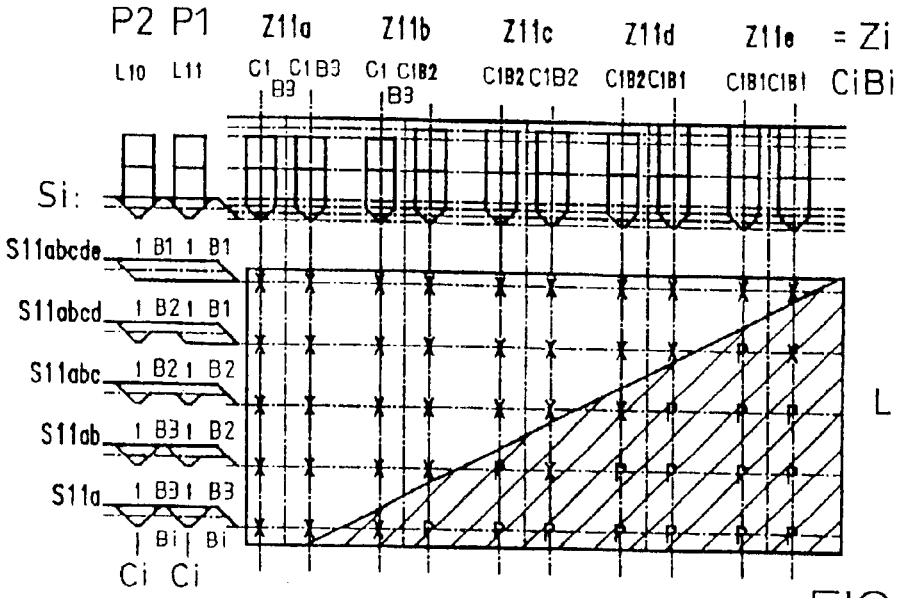
FIG. 16 shows a schematic locking function diagram with two positions and one market area.

FIG. 16 illustrates a bore pattern L with two positions P1=L11 and P2=L10 with blocking code B1, B2, B3 and coding steps L11=C1 and L10=C1, whereby with the blocking steps within a market area five derivations are created. For example, the key S11*abcde* opens the five cylinders Z11*a* to Z11*e* and the key S11*a* only opens the cylinder Z11*a*.

Figure 17:
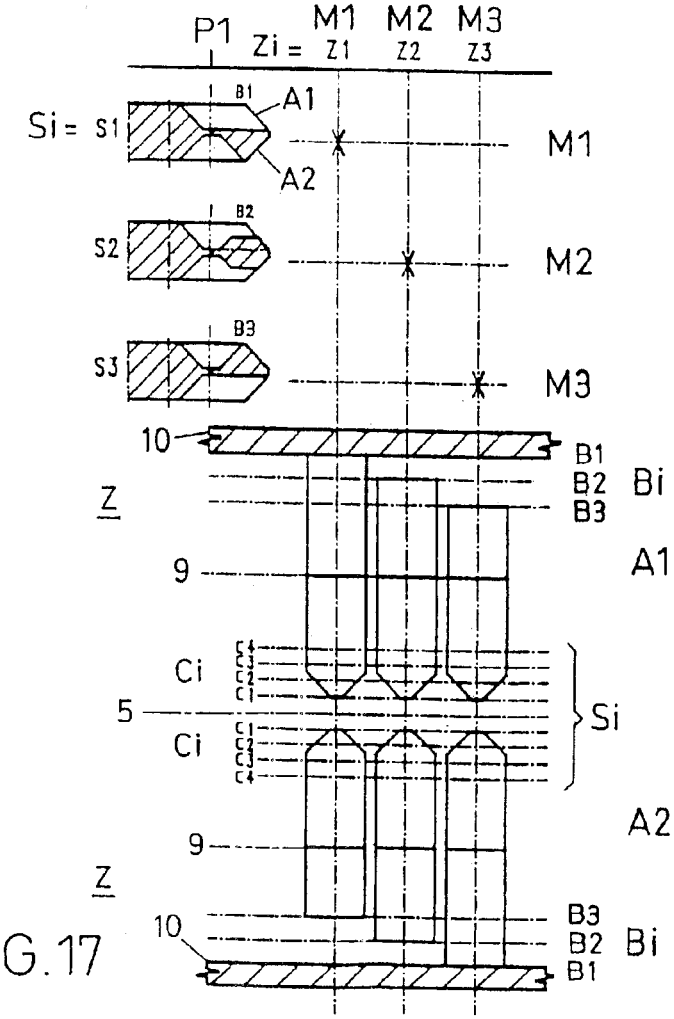
FIG. 17 shows a schematic locking function diagram with one position each in two tumbler pin rows and with three market areas.

FIG. 17 illustrates an example with only one position P1 each, however, in two rows of tumbler pins A1, A2. Both positions P1 are coded with C1, while with the blocking steps B1, B2, B3 of the blocking grooves three independent market areas M1, M2 and M3 are defined.

Figures 18, 19:
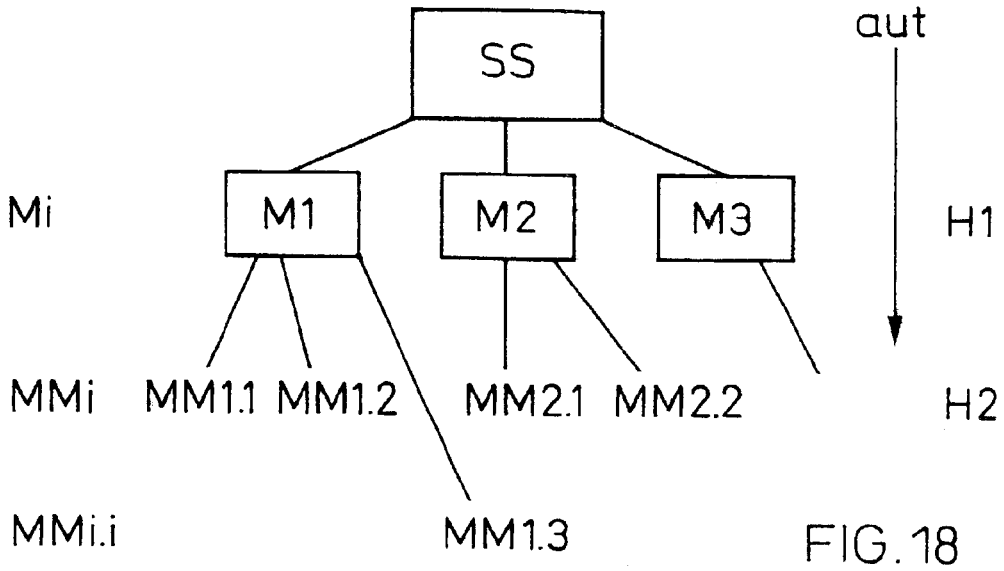
FIG. 18 shows an organization diagram of a locking system with segmented market areas and applications; and, FIG. 19 shows a schematic manufacturing diagram for keys of a locking system in accordance with the invention.

FIG. 18 illustrates an organization of the locking system in accordance with the invention with security reversible keys in a hierarchic schematic diagram. The system owner SS (e.g., a manufacturing company) represents the highest hierarchic level, which defines and authorizes the market areas Mi=Ml, M2, etc., on the key, whereby a market area may correspond to a country or a general distributor. In the market areas, further parts of areas MMi are defined on the key and separated and may, for example, correspond to different distributors or installations within this area. A further level MMi.i can define individual objects. This is defined by the codings of the areas G1 and G2.

FIG. 19 schematically illustrates a manufacturing method for keys of a system in accordance with the invention with manufacturing steps H, areas G on the key and with the manufactured variables Vi in the areas G. On principle the manufacturing H with reducing degree of difficulty HS takes place on lower levels, respectively, decentralized.

The variables Vi and security elements manufactured in the various areas Gi and in the corresponding manufacturing steps Hi, for example, are also indicated in the table.

With the manufacturing of keys and cylinders of a locking system with at least two areas G1 G2 on the keys, first the first area on the keys is manufactured (controlled and authorized) at a central place of manufacture H1 and the coding Cod1 of the keys of the second area G2 and the equipping of the cylinders with corresponding pins can subsequently take place at a local representative: H2.

The manufacturing can take place in at least two steps in different places, whereby first variables with a higher degree of difficulty HS of the area G1 are manufactured in a central location and subsequently variables with a lower degree of difficulty of the area G2 are manufactured decentralized or locally.

The manufacturing of the keys can also take place in three steps, whereby first the first area G1 with variables Vi of the highest degree of difficulty is manufactured centrally H1; thereupon a further area G1/2 with variables with a lower degree of difficulty is manufactured regionally: H1/2 and finally the coding G2 with the lowest degree of difficulty of the area G2 is manufactured locally at the place of use H2.

In a further development of the system, the manufacturing of the area G1 can also take place decentralized. To implement this, manufacturing programs and the authorization "aut" can be controlled and checked from the central location SS (system owner).

With the system in accordance with the invention and the manufacturing methods a universal differentiation of market areas and parts of market areas as well as a rapid local manufacturing are made possible.

Within the framework of this description, the following designations are used:

| | |
|---|---|
| x, y, z | Directions in space |
| x | Key axis |
| S, Si | Key |
| Z, Zi | Cylinder |
| Pi | Coding positions |
| R, L | Right-hand-, left-hand bore pattern |
| Ri, Li | Right-hand-, left-hand coding positions |
| Ai | Coding rows, pin rows |
| Bi | Coded blocking steps |
| Ci | Coding steps |
| BC | Blocking code |
| BN | Blocking groove |
| BZ | Blocking tumbler pin |
| BG | Blocking counter pin |
| BZ + BG | Pair of blocking tumbler pins, pair of blocking pins |
| lb | Length of BZ + BG |
| db | Distance from BN to 10 |
| tb | Depth of BN |
| bb | Width of BN |
| tc | Depth of the coding steps Ci |
| d1, d2, d3 | Diameters |
| Cod1 | Basic coding |
| Cod2 | Second (different) coding |
| KF | Control face |
| KS | Control pin |
| Mi | Market areas |
| MMi | Parts of market areas |
| SS | System owner |
| aut | Authorization |
| H1, H2 | Manufacturing steps |
| HS | Degree of manufacturing difficulty |
| G1, G2 | Areas on S |
| Vi | Variables, security elements |
| 5 | Central bisecting plane of S |
| 6 | Beveled tip of S, lead-in face of S |
| 8 | Surface of S |
| 9 | Shear line in Z |
| 10 | Cylinder housing |
| 11, 12 | Supporting surfaces at tumbler pins |
| 15 | Beveled face at tumbler pins |
| 21–23 | Various shapes of tumbler pins |
| 23 | Flat pin |

What is claimed is:

1. A security reversible-key with at least three coding pin rows (A1, A2, A3) located on flat sides of the key (S), with an assigned cylinder (Z) with tumbler pin rows of pairs of tumbler pins, said tumbler pin pairs consisting of tumbler pins and counter pins at the positions of the coding pin rows of a given bore pattern, wherein:

the key has a blocking groove (BN) in a coding pin row (A1, A2) that runs parallel to an axis (x) of the key from a tip of the key to at least a first coding position (P1) of the coding pin row on the key, the blocking groove has a coded blocking depth (B1, B2, B3) and, in the assigned cylinder at least at a rearmost coding position (P1'), a pair of blocking tumbler pins corresponding to the blocking groove (BN) with a blocking tumbler pin (BZ) and an extended blocking counter pin (BG) are received, wherein a total length (lb) of the blocking tumbler pin (BZ) and the blocking counter pin (BG) is almost equal to a distance (db) from the blocking groove (BN) to a cylinder housing (10), so that the blocking counter pin impinges on the cylinder housing (10) if the blocking groove is not deep enough and complete insertion of a key with an insufficiently deep blocking groove is blocked by the pair of blocking tumbler pins and whereby the blocking tumbler pin (BZ) together with the blocking counter pin (BG), following insertion of the key at the first coding position (P1) on the key, is also utilized as a coding tumbler pin with coding steps (C1, C2, C3, C4) for turning of the cylinder.

2. The key in accordance with claim 1, wherein at least four coding pin rows (Al–A4) are provided.

3. The key in accordance with claim 1, wherein at least two different codings (Cod1, Cod2) are provided.

4. The key in accordance with claim 1, wherein coding positions (Pi) from two different bore patterns (R, L) are provided.

5. The key in accordance with claim 1, wherein the blocking groove runs to at least the first two coding positions (P1, P2) at the very front of a coding pin row (A2) and by blocking tumbler pins (BZ1, BZ2) and blocking counter pins (BG1, BG2) corresponding to the coding positions, with coded step depths of these at least two positions at the very front.

6. The key in accordance with claim 5, wherein the blocking groove has at least two differently shaped sectors (BN1, BN2).

7. The key in accordance with claim 1, wherein the blocking groove extends over more than one coding position and whereby the depth (tb) of the blocking groove is constant or decreases from one coding position (P1) to the next coding position (P2).

8. The key in accordance with claim 1, wherein the blocking groove extends over more than one coding position and whereby the width (bb) of the blocking groove remains constant or decreases from one position (P1) to the next position (P2).

9. The key in accordance with claim 1, wherein at more than one coding pin row (A1, A2), respectively, one blocking groove each with assigned pairs of blocking tumbler pins is provided.

10. The key in accordance with claim 1, wherein, as an additional security element, a rising control face (KF) is disposed only at the tip of the key, said control face (KF) pushes an assigned control pin (KS) out of the way, whereby the control pin (KS) prevents insertion of a key without a control face (KF).

11. The key in accordance with claim 10, wherein the control pin (KS) is a flat pin (23), which also carries out a flank control at a narrow coding milling (Cod2).

12. The key in accordance with claim 1, wherein, in a coding pin row (A2), the following security elements are located: blocking code (BC), second coding (Cod2), insertion preventing system by means of control face (KF) and control pin (KS) as well as flank control by means of a flat pin (23).

13. A locking system with security reversible keys with at least three coding pin rows (A1, A2, A3), which are also located on flat sides of the keys (S), with assigned cylinders (Z) with tumbler pin rows of pairs of tumbler pins, said tumbler pin pairs consisting of tumbler pins and counter pins at the positions of the coding pin rows of a given bore pattern and with at least two additional security elements, wherein at least two areas on the keys are defined such that, in a first area (G1), at least two additional security elements with a higher degree of manufacturing difficulty are provided and, in the second area (G2), a more simple basic coding (Cod1) is provided, and wherein, with the first area (G1) an unequivocal segmentation into independent market areas (Ml, M2, . . . ) is defined whereby the first area (G1) has, as an additional security element, a blocking code (BC), the keys have a blocking groove (BN) in a coding pin row that runs parallel to an axis (x) of the key from a tip of the key to at least a first coding position (P1) of the coding pin row on the key, the blocking groove has a coded blocking depth (B1, B2, B3), and, in the assigned cylinder at least at the rearmost coding position (P1'), a pair of blocking tumbler pins with a blocking tumbler pin (BZ) and an extended blocking counter pin (BG) corresponding to the blocking groove (BN) are provided, wherein a total length (lb) of the blocking tumbler pin (BZ) and the blocking counter pin (BG) is almost equal to a distance (db) from the blocking groove (BN) to a cylinder housing (10), such that the blocking counter pin (BG) impinges on the cylinder housing (10) if the blocking groove is not deep enough to thereby block complete insertion of a key with an insufficiently deep blocking groove by the pair of blocking tumbler pins, and whereby the blocking tumbler pin (BZ) with the blocking counter pin (BG), after insertion of the key at the first coding position (P1) on the key, is also utilized as a coding tumbler pin with coding steps (C1, C2, C3, C4) for turning of the cylinder.

14. The locking system in accordance with claim 13, wherein, as security elements in the first area (G1), a second coding (Cod2), an insertion preventing means comprising a control face (KF) at the tip of the key and an assigned control pin (KS) in the cylinder, and a flank control comprising a flat tumbler pin (23) and a blocking code (BC) are provided.

15. The locking system in accordance with claim 13, wherein, the keys include areas having different bore patterns (R, L).

16. The locking system in accordance with claim 13, wherein at least three security elements are provided in the first area (G1).

17. The locking system in accordance with claim 13, wherein, as security elements, a second coding (Cod2) with a narrow milling is provided.

18. The locking system in accordance with claim 13, wherein all security elements of the first area (Gl) are affixed in one coding pin row (A2).

19. A method for manufacturing keys and cylinders of a locking system with at least two areas (Gl, G2) on the keys (S) in accordance with claim 13, wherein first the first area (G1) on the keys is manufactured in a central place of manufacture (Hl), and that the coding (Cod1) of the keys of the second area G2 and the equipping of the cylinders with corresponding pins is subsequently manufactured at a remote location by local representative (H2).

20. The method in accordance with claim 19, wherein manufacturing takes place in at least two steps at different locations, whereby first variables with a higher degree of difficulty (HS) of the first area (Gl) are manufactured at a central location and subsequently variables with a lower degree of difficulty of the second area (G2) are manufactured in a second decentralized location.

21. The method in accordance with claim 19, wherein manufacturing of the keys takes place in at least three steps, whereby first the first area (Gl) with variables of the highest degree of difficulty is manufactured centrally (Hl), thereupon a further area (G1/2) with variables with a lower degree of difficulty is manufactured regionally (H1/2) and finally the coding with the lowest degree of difficulty of the second area (G2) is manufactured locally at the place of application (H2).

22. The method in accordance with claim 19, wherein the manufacturing of the first area (Gl) is also able to take place decentralized, whereby manufacturing programs and authorization for a desired operation are controlled and checked from a central location.

* * * * *